US005772107A

United States Patent [19]

Younger

[11] Patent Number: 5,772,107

[45] Date of Patent: Jun. 30, 1998

[54] VENTILATED BOXES

[76] Inventor: Gordon M. Younger, 3701 S. Norfolk, Seattle, Wash. 98118-5639

[21] Appl. No.: 738,178

[22] Filed: Oct. 28, 1996

Related U.S. Application Data

[60] Continuation of Ser. No. 447,970, May 23, 1995, abandoned, which is a division of Ser. No. 235,665, Apr. 29, 1994, abandoned.

[51] Int. Cl.[6] ..... B65D 5/32

[52] U.S. Cl. ..... 229/23 R; 229/120

[58] Field of Search ..... 229/23 R, 120; 217/40, 42

[56] References Cited

U.S. PATENT DOCUMENTS

| | | | |
|---|---|---|---|
| 536,506 | 3/1895 | Boatwright | 217/42 |
| 876,061 | 1/1908 | Katzenstein | 217/40 |
| 1,697,709 | 1/1929 | Bliss | 229/23 R |
| 1,838,726 | 12/1931 | Workman | 217/40 |
| 2,401,742 | 6/1946 | Bentham | 229/23 R |
| 3,040,954 | 6/1962 | Salmon | 229/23 R |
| 3,927,822 | 12/1975 | Giebel | 229/23 R |
| 4,291,830 | 9/1981 | Sorensen | 229/23 R |
| 4,497,408 | 2/1985 | Jes | 229/23 R |
| 4,513,907 | 4/1985 | Grosshuesch | 229/23 R |
| 5,361,974 | 11/1994 | Earl et al. | 229/23 R |

FOREIGN PATENT DOCUMENTS

| | | | |
|---|---|---|---|
| 367335 | 10/1906 | France | 217/42 |

*Primary Examiner*—Gary E. Elkins
*Attorney, Agent, or Firm*—Hughes, Multer & Schacht, P.S.

[57] ABSTRACT

Ventilation panels for boxes and cartons and methods and apparatus for manufacturing those panels at production levels. The ventilation panels include a pest barring, gas transmitting screen trapped between two segments of the material from which the panel is made.

5 Claims, 6 Drawing Sheets

VENTILATED BOXES

This application is a continuation of application Ser. No. 08/447,970 filed on May 23, 1995, abandoned, which is a divisional of application Ser. No. 08/235,665 filed on 29 Apr. 1994, abandoned.

TECHNICAL FIELD OF THE INVENTION

The present invention relates primarily to novel, improved methods and apparatus for making ventilation panels for boxes (or cartons).

BACKGROUND OF THE INVENTION

Many foreign countries and local jurisdictions such as the State of California require that fresh fruit entering the jurisdiction be quarantined before it is shipped to its final destination. The purpose of the quarantine process is to ensure that the fruit is not contaminated with insects or other pests.

Perhaps the most prevalent way of handling fruit subject to quarantine regulations at the present time is to fumigate the fruit in bulk and then package it in plastic bags sealed to make them quarantine secure. This however creates an anaerobic environment in which the fruit will soon begin to suffer a loss of freshness. As a consequence, rapid transport of the fruit to the quarantine station and then to its ultimate destination is required, especially for cross-country, overseas, or far away destinations. This generally means that the fruit must be shipped by expensive air freight to keep it from spoiling before it reaches the ultimate market. This severely restricts the quantity of fruit that can be sold in such markets.

Heretofore, it has been proposed that this problem of degradation of fresh fruit be solved by shipping the fruit in a ventilated box. Technically, this approach is satisfactory in that appropriate screening keeps pests from the treated fruit, yet allows fumigating gases and air to circulate freely through the box and delays the loss of freshness. As a consequence, fresh fruit may be shipped long distances by modes which cost only a fraction of air freight—ship, rail, truck, etc.

Also, any insects which may have survived the fumigation process are trapped and cannot proliferate outside of the box. Furthermore, ventilated boxes make it practical to fumigate the packaged fruit rather than first fumigating the fruit and then packing it with the attendant risk of recontamination.

One type of heretofore proposed ventilated box has sides or ends with apertures spanned by a screen bonded to the inside of the box. These boxes have the decided disadvantage that the screen is not secure. Also, the screen marks the skin of the fruit packed in the box, causing a significant degradation in quality.

It was recognized that the problems of insecure screens and marking of the packed fruit could be overcome by incorporating the screen in a ventilation panel to isolate the screen from the fruit. The ventilated boxes of this type heretofore employed were manufactured by hand. This approach is not practical due to the large volumes of containers required and because of the cost of the hand-manufactured boxes.

SUMMARY OF THE INVENTION

There have now been invented and disclosed herein certain new and novel methods and apparatus which make it possible to produce ventilated fruit boxes economically and in the required volumes. Generally speaking, the approach is to first manufacture screened end or side panels and then assemble these to an appropriately configured box blank to complete the manufacturing process.

The ventilation panels are fabricated by cutting an appropriate screen stock material to length in timed relation to the arrival of panel blanks at an applicator station. The screens are there applied to the blanks which have been previously coated with a suitable adhesive. A segment of the blank is then folded over the screen and pressed against that segment to which the screen has been applied to bond the segments of the blank together with the screen therebetween. This may be followed by compression of the blank to ensure that the screen trapping segments are firmly bonded together.

The advantages, important features, and objects of the invention will be apparent to the reader from the foregoing and the appended claims and as the ensuing detailed description and discussion proceeds in conjunction with the accompanying drawings.

DETAILED DESCRIPTION OF THE DRAWING

Figure 1:
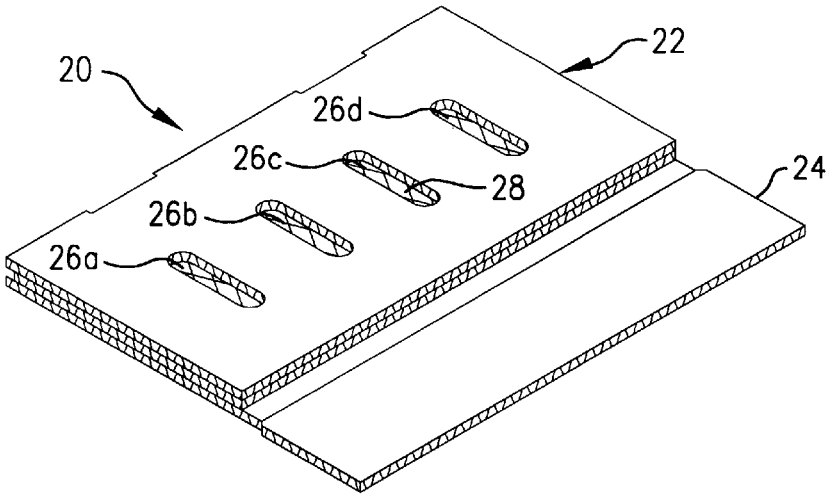
FIG. 1 is a perspective view of a ventilated box panel embodying and constructed in accord with the principles of the present invention.
Figure 2:
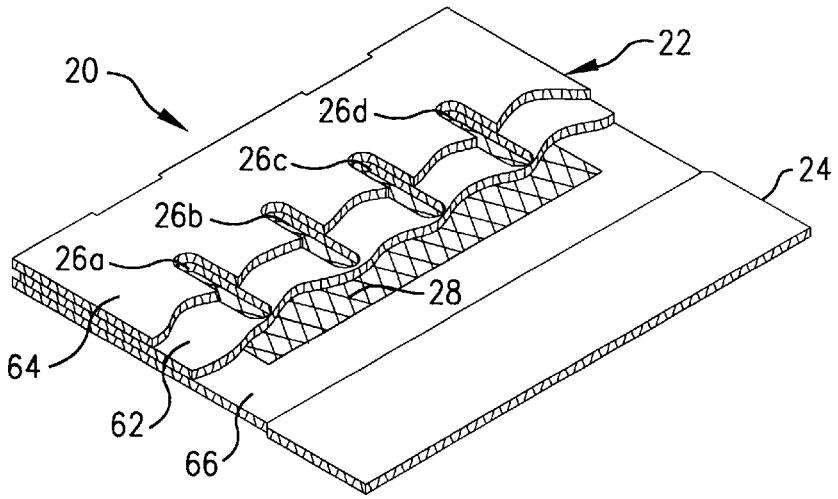
FIG. 2 is a generally perspective view of the ventilation panel with parts of the panel broken away to show its construction.

Referring now to the drawing, FIGS. 1 and 2 depict a fruit box ventilation panel 20 constructed in accord with, and embodying, the principles of the present invention. Panel 20 has a main body section 22 and an integral, foldable, top closure flap 24. Ventilation openings 26*a–d* are formed in the body 22 of the panel. A screen 28 extends across ventilation openings 26*a–d* and keeps insects and other pests from migrating through the ventilation openings while allowing air and other gases to freely pass therethrough.

Figure 3:
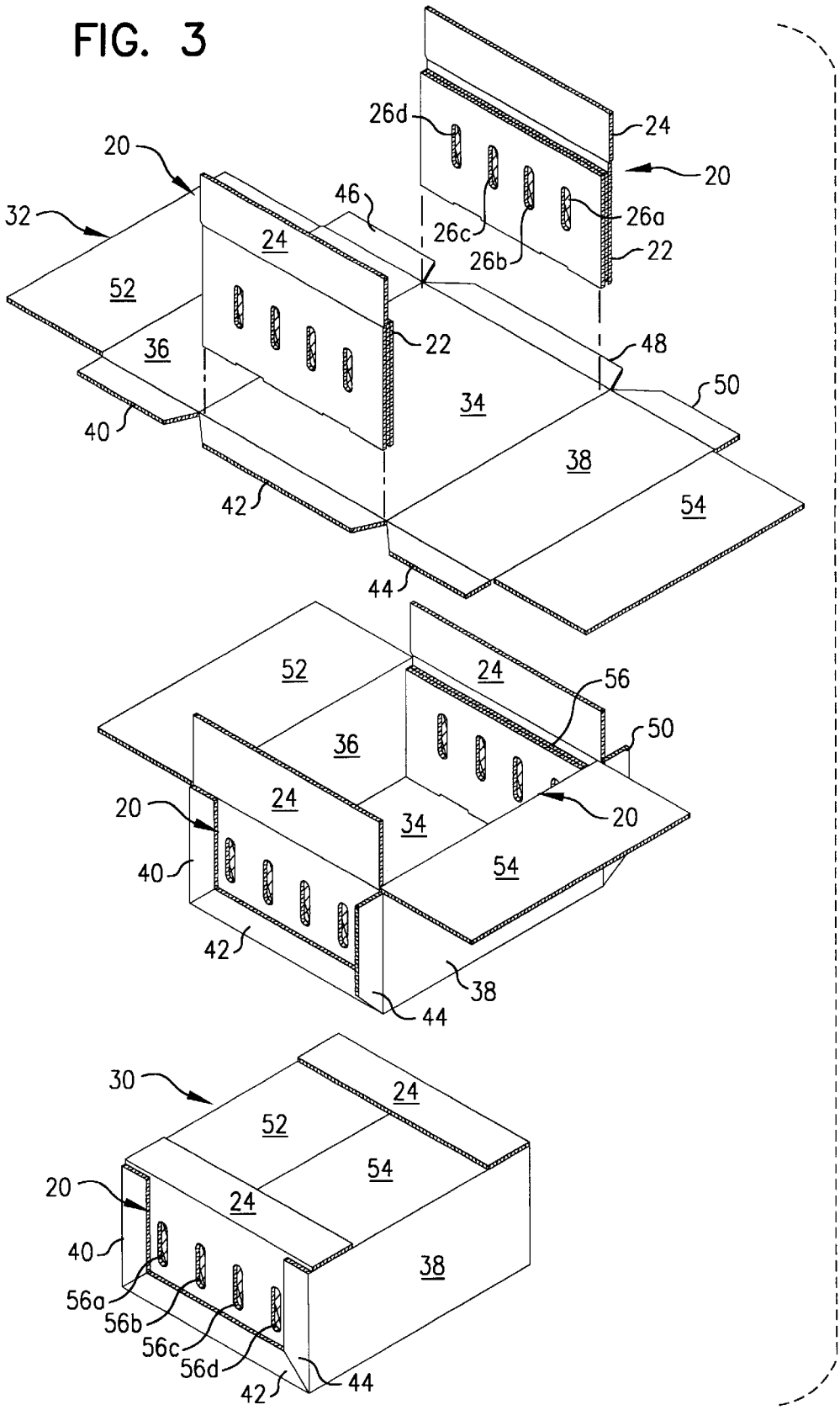
FIG. 3: (a) depicts a box with ventilated end panels of the character shown in FIG. 1, and (b) shows the steps employed to assemble the box.

Turning next to FIG. 3, a representative ventilated box 30 embodying the principles of the present invention is assembled from two ventilation panels 20 of the character just described (employed in this case as end panels) and a box blank 32.

End panels 20 are positioned on a segment 34 of blank 32 which forms the bottom of the completed box 30. Integral box blank segments 36 and 38 are folded up to form the sides of box 30. Integral box blank flaps or segments 40 . . . 50 are then folded into contact with, and adhesively bonded to, the two ventilation panels 20 to complete the assembly. Thereafter, box 30 is filled, the two flaps 52 and 54 at the opposite ends of box blank 32 are folded inwardly until they rest on the ledges 56 at the upper ends of ventilation panels 20, and the flaps 24 of those panels are folded over and adhesively bonded to flaps 52 and 54 to seal box 30 as shown at the bottom of FIG. 3.

Figure 4:
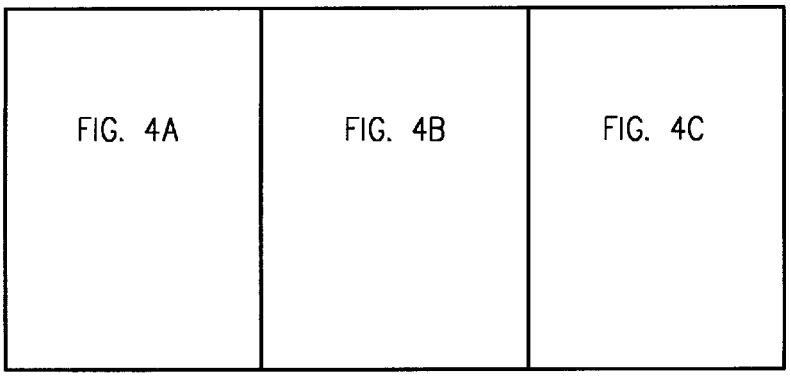
FIG. 4 shows the relationship among FIGS. 4A–4C which, taken together, constitute a generally schematic illustration of one system for making ventilation panels of the character illustrated in FIG. 1.

Referring now to FIG. 4, ventilation panel 20 is fabricated from a panel blank 60 and the above-described pest trapping, gas passing screen 28. The exemplary panel blank 60 shown in FIG. 4 includes: (a) three integral segments 62, 64, and 66 which are folded together to form the body 22 of the ventilation panel, and (b) the also integral closure flap 24. Complementary, registrable apertures 68*a–d*, 70*a–d*, and 72*a–d* are formed in the integral segments 62, 64, and 66 of ventilation panel blank 60. In the completed ventilation panel 20 (FIGS. 1 and 2), the corresponding apertures in the panel segments 62, 64, and 66 form the ventilation openings 26*a–d* in the panel.

Blank 60 can be fabricated from any of the materials available for the manufacture of boxes and cartons. These include coated and uncoated, porous and impervious cardboards and paper laminates, plastics, woods, and other materials which provide a combination of quarantine security and stacking strength. The representative material illustrated in the drawings is double faced, corrugated box board.

Screens extruded from polypropylene and other appropriate polymers are preferred because those segments of material making up the screen are integral and cannot move relative to each other as can the strands of a woven screen. Movement of the strands in a woven screen may allow an opening through the screen to enlarge to the extent that a pest can penetrate the screen. In addition to cost and other considerations, the selected polymer must be one which will not react chemically with the fumigating agent being used.

One suitable polypropylene screen stock material has a thickness of about 0.060 in and openings approximately 1.3 mm in diameter, which is smaller than the 1.5 mm maximum permitted by representative (Japanese) quarantine regulations. This material, which is available from Conway Company, has the ability to bar fruit flies and other pests. At the same time, it readily passes gases used for in-box fumigation of fruit and air forced through the fruit box to cool the fruit and delay the onset of degradation and a consequent loss of freshness.

One exemplary machine for converting panel blanks 60 and screens 28 into ventilation panels of the character identified by reference character 20 in FIGS. 1 and 2 is illustrated in FIG. 3 and identified by reference character 74. Machine 74 includes a frame 76, a vacuum belt conveyor system 78 for advancing blanks 60 through the machine, and a motor 80 which drives the various operating components of the machine by way of a drive belt system 82.

A feed table 83 at the left-hand, upstream end of machine 74 supports a stack 84 of ventilation panel blanks 60. Blanks 60 are removed one at a time from the bottom of stack 84 and advanced by vacuum belt conveyor system 78 to an adhesive applicator 86 which reciprocates toward and away from the vacuum belt conveyor system in timed relation to the arrival of blanks 60 at the applicator as indicated by arrow 88 in FIG. 4A. As each ventilation blank 20 arrives at applicator 86, adhesive is applied to the upper surface 90 of the integral, screen-receiving segment 66 of the blank. The area covered by the adhesive is identified by reference character 92 in FIG. 4A. A wide variety of suitable hot melt and cold adhesives are available, and any desired one of these may be employed.

Figure 5:
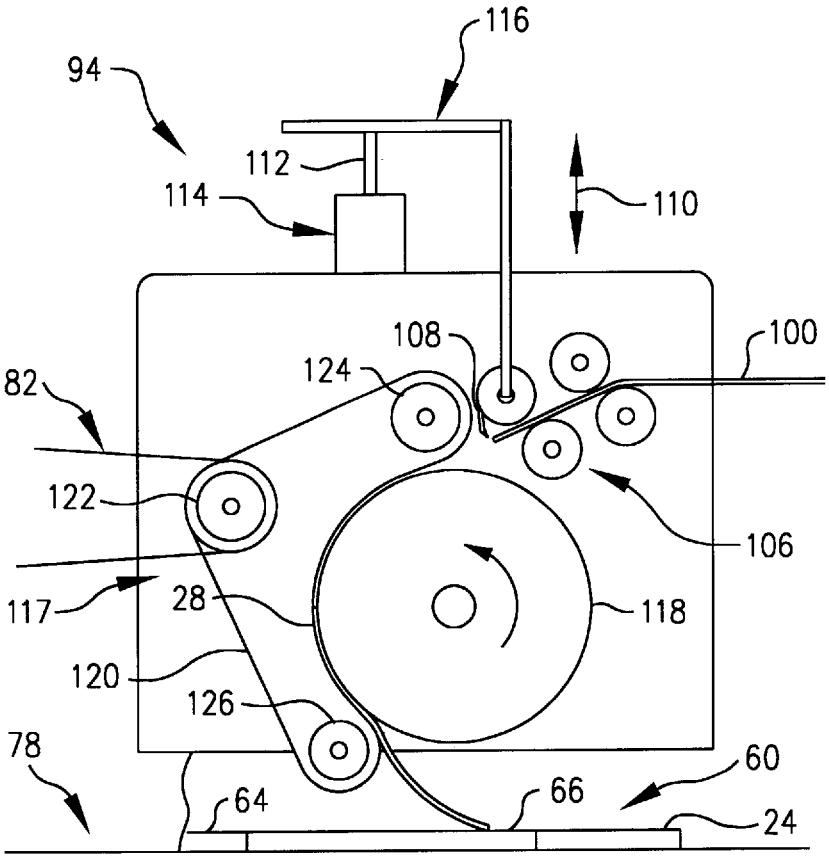
FIG. 5 shows, in more detail, but still schematically, a screen applicator station of the system shown in FIG. 4.

The ventilation panel blank 20 is advanced by vacuum belt conveyor system 78 from adhesive applicator 86 to a screen applicator station 94, which is shown in more detail in FIG. 5. At the same time, the selected screen stock material is supplied to applicator station 94 from a roll stand 96 by way of a festoon accumulator 98. In that device, the screen stock material 100 unwound from the roll 102 of that material in roll stand 96 is formed into a series of loops 104. This produces a reserve from which screen stock material 100 can be supplied to screen applicator station 94 even when the screen stock material is not being fed to the festoon accumulator. This allows an operator to remove an exhausted screen stock roll 102 from roll stand 96, replace it with a fresh roll, and splice the trailing end of the exhausted roll to the leading end of the fresh roll, allowing rolls to be changed without shutting down machine 74.

Figure 4A:
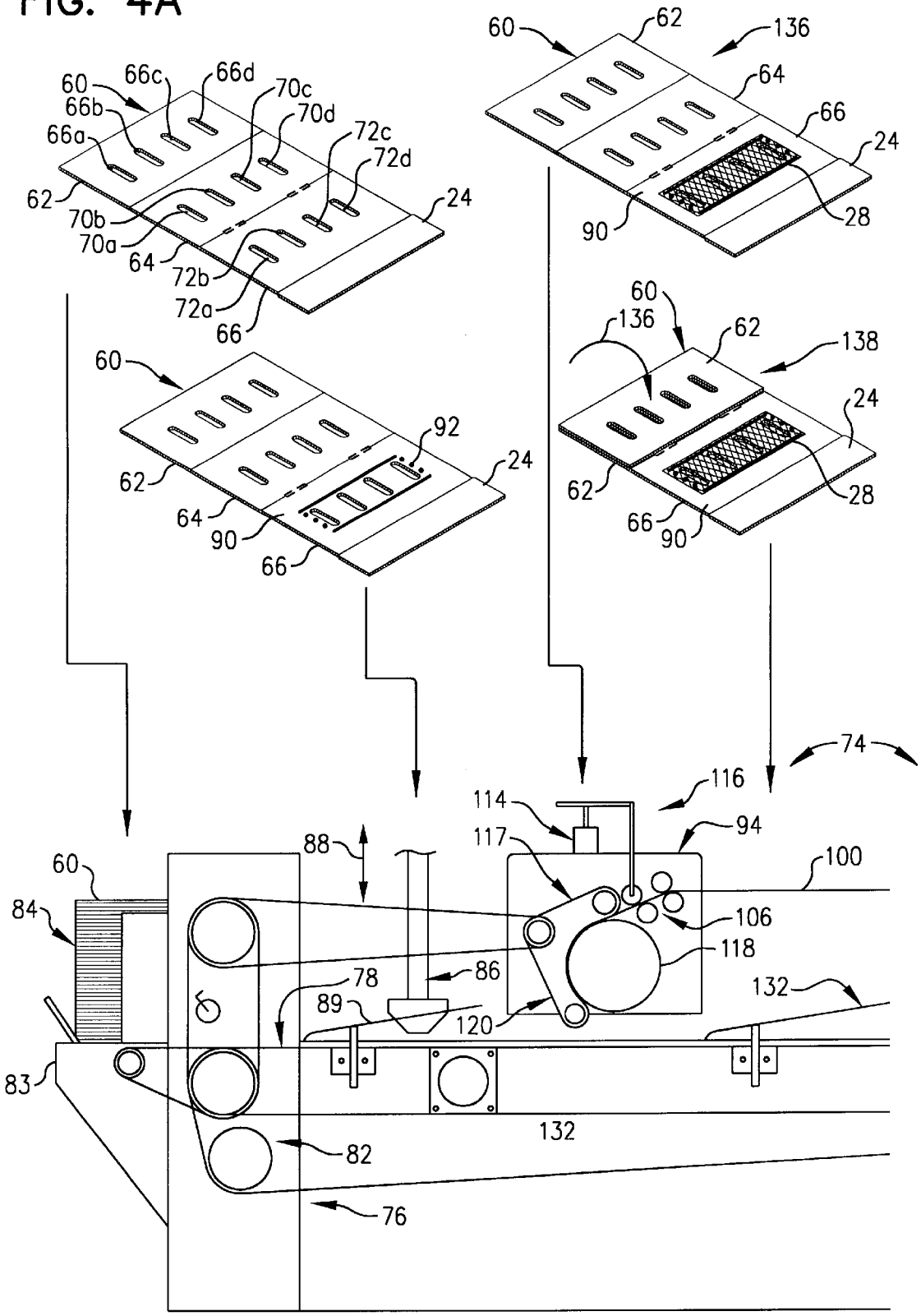

Referring now to FIGS. 4A and 5, the incoming screen stock material 100 is advanced through screen applicator station 94 by a feed roll system 106. Screens 28 are cut from feedstock material 100 in timed relationship to the arrival of a previously glued panel blank 60 at screen applicator station 94 by a knife 108. The knife is supported for bidirectional, rectilinear movement in the directions indicated by arrow 110 in FIG. 5 from the piston 112 of a hydraulic cylinder 114. The knife support system is identified by reference character 116.

The screen 28 cut from the feedstock material by knife 108 is conveyed by a feed system 117 comprised of a rotating roll 118 and an endless belt 120 trained around drive roller 122 and idle rollers 124 and 126 to the previously glued, ventilation panel blank 60 being advanced through the applicator station 94 by vacuum belt conveyor system 78. There, the screen 28 is ejected onto the upper surface 90 of the blank segment 66 to which adhesive had previously been applied by adhesive applicator 86. The movements of the screen 28 and blank 60 are timed to place screen 28 on blank segment 66 with screen 28 over those apertures 72*a–d* in segment 66 which become part of ventilation openings 26*a–d* in the completed ventilation panel 20. The blank/screen assembly at this manufacturing stage is illustrated in FIG. 4A and identified by reference character 130.

From screen applicator station 94, the assembly 130 of ventilation panel blank 60 and screen 28 is advanced by vacuum belt conveyor system 78 to and over two conventional, stationary, folding ploughs 132 and 134. Plough 132 folds panel blank segment 62 over and into contact with the adjacent, integral panel segment 64 as indicated by arrow 136 in FIG. 4A. At this juncture, the blank/screen assembly is configured as shown by reference character 138 in FIG. 4A.

Figure 4B:
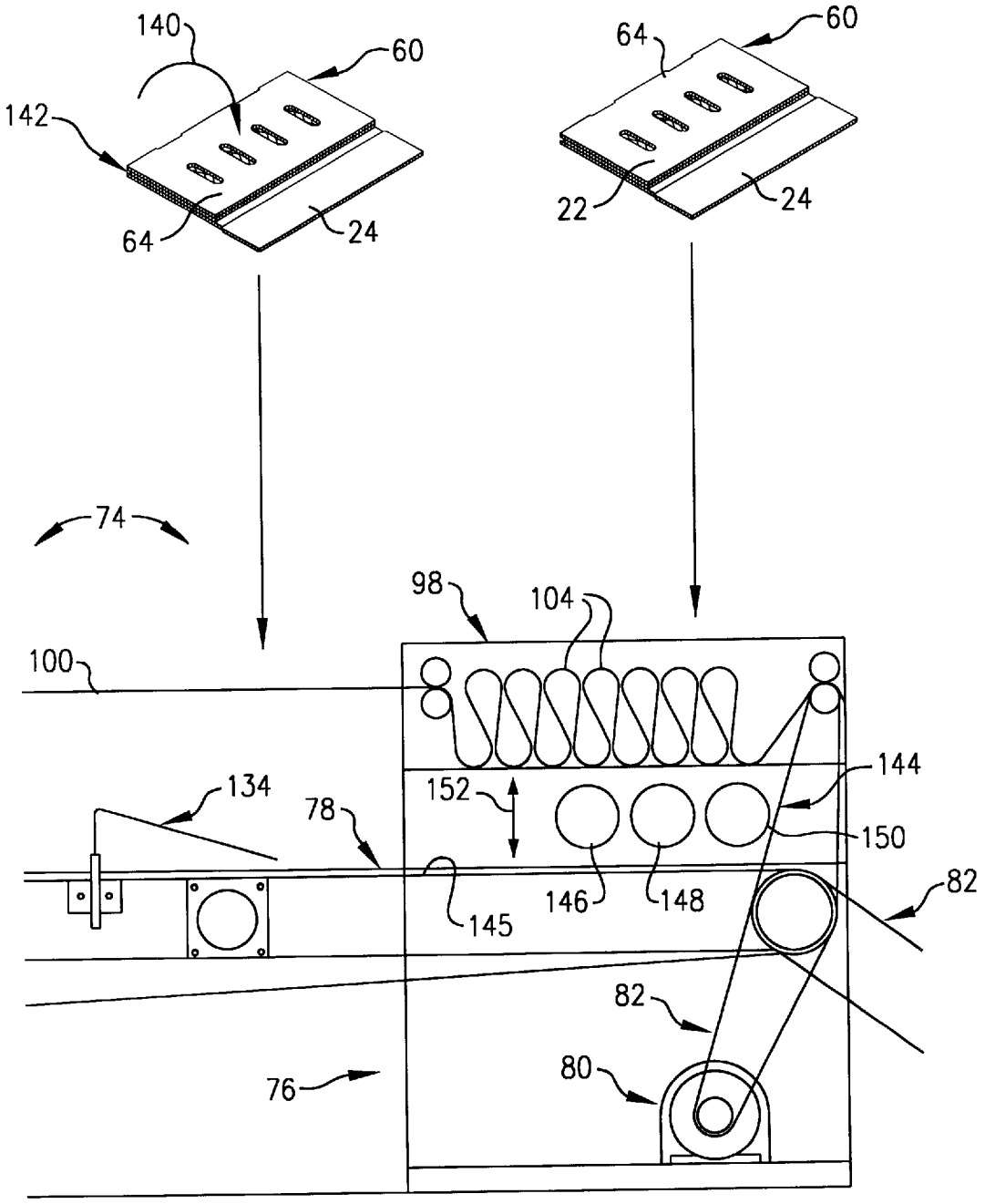
Figure 4C:
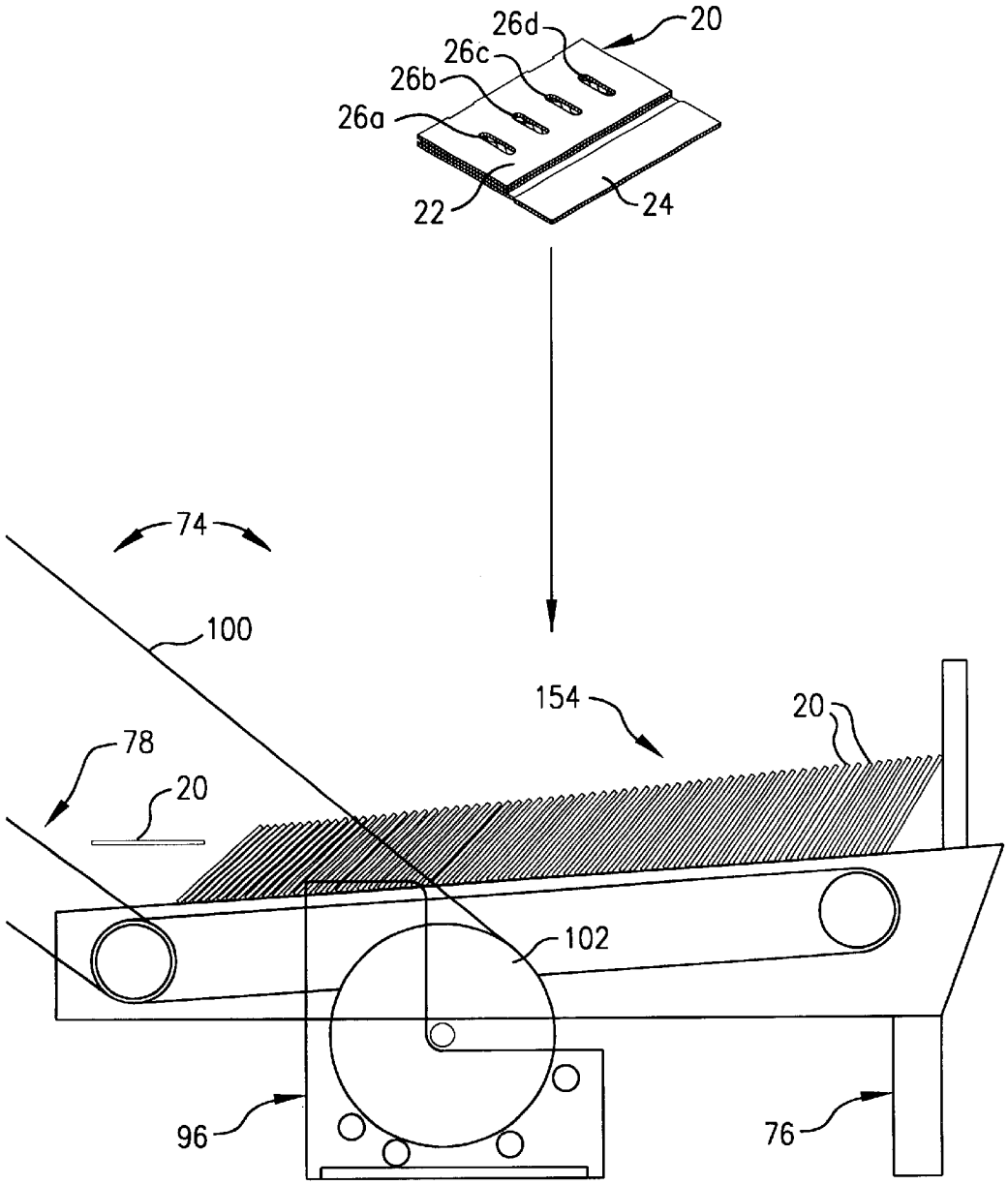

The second plough 134 folds ventilation panel blank segments 62 and 64 over screen 28 as shown in FIG. 4B by arrow 140 and into contact with the third, integral segment 66 of the blank 60. The previously applied adhesive in area 92 on the upper surface 90 of segment 66 bonds the segments 62 and 64 of the blank to adhesively coated segment 66 with: (a) screen 28 trapped between segments 62 and 66, and (b) the corresponding apertures 68*a–d*, 70*a–d*, and 72*a–d* in the three segments 62, 64, and 66 of the blank 60 aligned to form ventilation openings 26*a–d*. The ventilation panel at this stage of manufacture is identified by reference character 142 in FIG. 4B.

Vacuum belt conveyor system 78 next advances the partially fabricated ventilation panel from the second folding plough 134 to a compression section 144 of machine 74. Here, the conveyor system vacuum belt and the blank are solidly supported on a table 145. Compression rolls 146 . . . 150 supported for bidirectional movement in the directions indicated by arrow 152 in FIG. 4B compress folded over segments 62 and 64 of panel blank 60 against screen 28 and segment 66 of the blank to ensure that there are no gaps in the adhesive in area 92 and that a secure, firm bond is consequently formed.

From compression section 144, the completed ventilation panels 20 are advanced by vacuum belt conveyor system 78 to a delivery section 154 of machine 74. Here, the ventilation panels 20 are pulled and packed.

The principles of the present invention can be employed in the manufacture of a variety of ventilated box and carton panels other than the exemplary triple wall panel discussed above. An exemplary one of these is a double wall panel with two, integral panels which can be folded together with the screen trapped therebetween.

The invention may be embodied in still other forms without departing from the spirit or essential characteristics of the invention. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. Ventilation panels manufactured by a method which comprises the steps of:

providing blanks with complementary ventilation openings in first, second, and third integral segments thereof;

folding the second, integral segment of each of each of said blanks over and into contact with said first integral segment;

advancing said blanks seriatim to a screen applicator station;

supplying to said applicator station screen stock material having openings sufficiently small to bar insects but large enough for the ingress and egress of gases;

cutting screens from said stock material at the applicator station in timed relationship to the arrival of said blanks at said applicator station;

adhesively bonding said screens to the third segments of said blanks over the ventilation openings in said third segments; and thereafter mechanically folding the first and second, integral segments of each said blank over the screen bonded to the third segment of that blank and into adhesively bonded relationship with said third segment such that the screen is trapped between said first and third segments and the ventilation openings in the first, second, and third segments are aligned.

2. Ventilation panels as defined in claim 1 which are manufactured by a method that also comprises the step of pressing the folded first and second segments of each blank against the third segment thereof to promote a firm bond between the first and third segments.

3. Ventilation panels as defined in claim 1 which are manufactured by a method that also includes the step of applying an adhesive to a screen receiving surface of each of said blanks prior to the arrival of each of said blanks at said applicator station.

4. Ventilation panels as defined in claim 1 in which said screen stock is a material with openings defined by segments of material that are restrained against movement that might enlarge one of said openings and permit an insect to pass through the screen.

5. A box which comprises a pair of side walls, a pair of end walls, a bottom, and a closable top, the walls in one of said pairs comprising ventilation panels each manufactured by a method as defined in claim 1.

* * * * *